US005478978A

United States Patent [19]

Taylor et al.

[11] Patent Number: 5,478,978

[45] Date of Patent: Dec. 26, 1995

[54] ELECTRICAL SWITCHES AND SENSORS WHICH USE A NON-TOXIC LIQUID METAL COMPOSITION

[75] Inventors: Larry T. Taylor; James Rancourt, both of Blacksburg; Carlos V. Perry, Jr., Manassas, all of Va.

[73] Assignee: The Center for Innovative Technology, Herndon, Va.

[21] Appl. No.: 199,875

[22] Filed: Feb. 22, 1994

Related U.S. Application Data

[63] Continuation-in-part of Ser. No. 22,118, Feb. 25, 1993, Pat. No. 5,391,846.

[51] Int. Cl.[6] ..... H01H 29/06

[52] U.S. Cl. ..... 200/233

[58] Field of Search ..... 200/233, 234; 141/64, 63, 4

[56] References Cited

U.S. PATENT DOCUMENTS

| | | | |
|---|---|---|---|
| 3,462,573 | 8/1969 | Rabinowitz et al. | 200/233 |
| 5,021,618 | 6/1991 | Ubukata et al. | 200/233 |

FOREIGN PATENT DOCUMENTS

| | | | |
|---|---|---|---|
| 3912153 | 8/1990 | Germany | 141/63 |

*Primary Examiner*—Renee S. Luebke

*Attorney, Agent, or Firm*—Whitham, Curtis, Whitham & McGinn

[57] ABSTRACT

Liquid gallium or gallium alloy is utilized as the conductive fluid in a switch or sensor housing. In order to prevent wetting of the interior walls of the switch or sensor housing, the liquid gallium or gallium alloy is either free of metal oxides or has only very low quantities of metal oxides.

14 Claims, 1 Drawing Sheet

ELECTRICAL SWITCHES AND SENSORS WHICH USE A NON-TOXIC LIQUID METAL COMPOSITION

CROSS-REFERENCE TO RELATED APPLICATIONS

This patent application is a continuation-in-part (CIP) application of the patent application having U.S. Ser. No. 08/022,118 filed Feb. 25, 1993, now U.S. Pat. No. 5,391,846, the complete contents of which are herein incorporated by reference.

BACKGROUND OF THE INVENTION

1. Field of the Invention

The subject invention is generally directed to non-toxic substitutes for mercury in electrical switch and sensor applications. More particularly, the invention is directed to certain gallium alloys that have desirable properties for use in electrical switches and sensors, and to procedures and apparatuses for producing electrical switches which utilize gallium alloys.

2. Description of the Prior Art

Mercury is used extensively in switches and sensors. In a common switch application, liquid mercury is positioned inside a fluid tight housing into which a pair of spaced electrodes extend. Depending on the physical orientation of the housing, the liquid mercury can provide a conductive pathway between the electrodes or be positioned such that there is an open circuit between the electrodes. An important physical attribute of mercury is that it remains fluid throughout a wide temperature range. This attribute allows mercury to be used in many different environments and in environments with constantly changing temperature parameters. Another important physical attribute of mercury is that it has significant surface tension and does not wet glass, metal or polymer surfaces. However, mercury is toxic to humans and animals. As such, finding non-toxic alternatives to mercury that have comparable performance characteristics would be beneficial.

Two examples of prior art references which discuss gallium alloys as non-toxic substitutes for mercury in switch applications include U.S. Pat. No. 3,462,573 to Rabinowitz et al. and Japanese Patent Application Sho 57-233016 to Inage et al. Both documents identify gallium/indium/tin alloys as being potentially useful. Gallium has the advantages of remaining in the liquid phase throughout a wide temperature range and has a very low vapor pressure at atmospheric pressure. Combining other metals with gallium can depress the freezing point for the composition below that of gallium alone (29.7°). Rabinowitz et al. states that a 62.5% gallium, 21.5% indium, and 16% tin composition forms an alloy that has a freezing point of 10° C. The Japanese Patent Application to Inage asserts that adding 1–3.5% silver to a gallium/indium/tin alloy can lower the freezing point closer to 0° C. It would be advantageous to identify an alloy which has a freezing point as close to 0° C. as possible in order for the alloy to be used in the largest and broadest possible number of switch and sensor applications.

Neither Rabinowitz et al. nor Inage et al. discuss "wetting" problems encountered with gallium alloys. Rather, they suggest that the gallium alloy can be used in an envelope made of a material that is not wetted by gallium. As will be discussed below, gallium oxide, which is readily formed in gallium alloys, has the disadvantage of wetting many different surfaces.

SUMMARY OF THE INVENTION

It is an object of this invention to provide a gallium alloy that has performance properties at least as good as or better than mercury in electrical switch and sensor applications.

It is another object of this invention to provide a superior method for producing an electrical switch which utilizes gallium or gallium alloys.

It is yet another object of this invention to provide an apparatus which will allow electrical switches that employ gallium and gallium alloys to be prepared without oxidation of the gallium during and after the fabrication process.

According to the invention, processes and apparatuses have been developed which enable electrical switches and sensors that use gallium and gallium alloys as the electrical conducting fluid therein to be produced without oxidation of the metal occurring during or after switch or sensor fabrication. It has been discovered that gallium alloys are extremely prone to oxidation and that even slight oxidation of the metal will be detrimental to the performance of the switch or sensor. In particular, oxidation of the metal leads to wetting of the switch housing, bridging of the electrodes, sluggish movement of the alloy, and poor contact between the alloy and the electrodes. In addition, it has been discovered that incorporating small amounts of bismuth within specified ranges in a gallium alloy effectively suppresses the freezing point of the gallium alloy to near 0° C.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Figure 1:
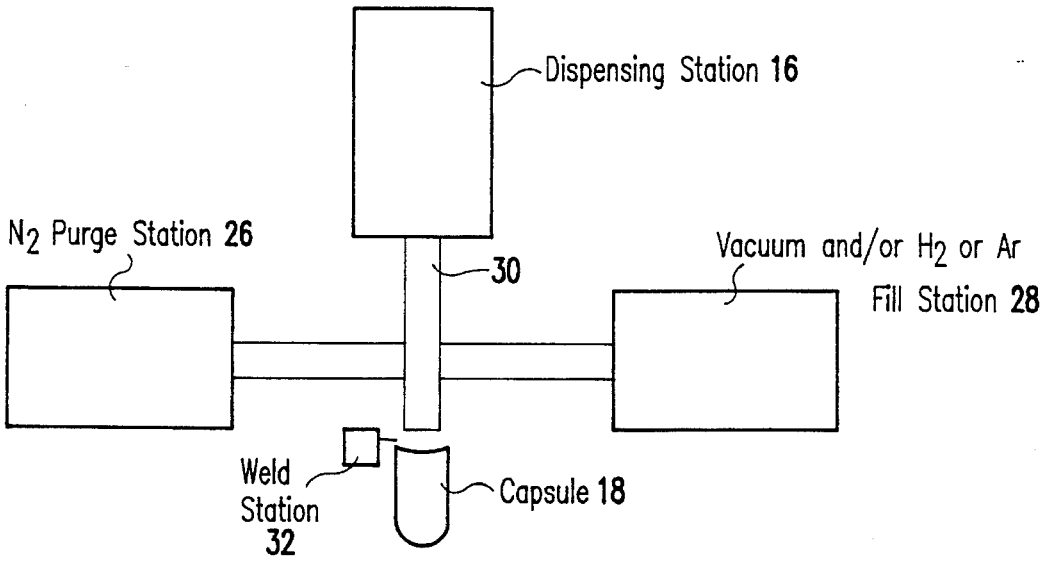
FIG. 1 is a schematic diagram showing an apparatus for filling a switch housing with gallium or a gallium alloy.

This invention is particularly related to electrical switches and sensors that employ gallium and gallium alloys as a non-toxic substitute for mercury. It should be understood that a wide variety of metals can be combined with gallium to practice the present invention (e.g., silver, gold, lead, thallium, cesium, palladium, platinum, sodium, selenium, lithium, potassium, cadmium, bismuth, indium, tin, antimony, etc.).

Gallium/indium/tin alloys have proven to have particular potential as a mercury substitute. Gallium/indium/tin alloys are commercially available from Johnson Matthey at 99.99% purity (62.5% Ga, 21.5% In, and 16% Sn). Typically, the primary component of the gallium/indium/tin alloy is gallium and it constitutes approximately 60–75% of the composition. Indium is generally incorporated in the composition at level of 15–30% and tin is incorporated at a level of 1–16%. A practical problem with gallium, indium, tin and other potential constituents of low melting alloys is the propensity of the constituents to form surface oxide layers. These materials must be kept under a nonoxidizing atmosphere at all times to obtain optimum electrical and physical properties from the alloy. Further, if the surfaces of the constituents have oxidized the oxide results in the need for more vigorous alloy preparation methodologies.

A problem with one commercially available gallium/indium/tin alloy is that it has a freezing point of approximately 11° C. While this freezing point is lower than gallium alone (29° C.), many electrical switch applications require performance at or below the freezing point of water (0° C.). Adding small quantities (less than 5%) of other non-toxic elements such as lithium, sodium, rubidium, silver, antimony, gold, platinum, cesium and bismuth to the gallium/indium/tin alloy provides a mechanism for depressing the freezing point of the alloy. However, experiments have demonstrated that the quantity of the additive needs to be controlled to achieve freezing point depression.

Table 1 lists the compositions of a plurality of alloys that have been prepared and their physical state at 4° C.

TABLE 1

| % Ga | % In | % Sn | % Ag | % Bi | Physical state |
|---|---|---|---|---|---|
| 62.5 | 21.5 | 16 | | | solid |
| 61.99 | 25 | 13 | | | solid |
| 67.98 | 20.01 | 10.5 | 1.51 | | liquid |
| 59.52 | 20.48 | 15.24 | 4.76 | | solid |
| 67.99 | 20 | 10.5 | | 1.51 | solid |
| 68.10 | 19.9 | 10.5 | 1.1 | 0.4 | liquid |
| 67.98 | 20.02 | 10.5 | 0.75 | 0.75 | liquid |
| 67.98 | 20.01 | 10.5 | 0.38 | 1.13 | solid |

The freezing point data for the compositions shown in Table 1 were determined using an ice water bath. Table 1 demonstrates that the Ga/In/Sn/Ag alloys described in the Inage et al. Japanese Patent Application do not necessarily depress the freezing point below 4° C. Rather, it was observed that most of these compositions began to solidify at 5° C. and were completely solid at 4° C. Table 1 also shows that gallium alloys that include a small amount of bismuth remain liquid at 4° C.

One particular formulation (68%Ga, 20%Sn, 10.5%In, 0.75%Bi, 0.75%Ag) was found to have a freezing point near −4° C. This determination was made in a salt/ice water bath. In principle, the reduction in freezing point of the water bath induced by the addition of impurities (salt) is the operating principle for the preparation of low melting alloys. That is, the intentional addition of impurities to a pure compound or to a mixture of compounds reduces the melting point of the host material. The general direction of the preparation of novel alloys involves the addition of minor amounts of additional ingredients; less than approximately 10% on a weight basis. Also, the crystal structure and atomic size of the additional ingredients are preferably different from these properties for the host matrix. This helps to insure that crystallization of the host alloy is inhibited.

An additional property expected for the low melting alloys is a lower bulk electrical resistivity than mercury metal. This is based on tabulated data that shows that all of the major ingredients of the claimed low melting alloys are approximately twenty times more conductive than mercury metal. This, in combination with the proper choice of electrode wires will allow switches of a particular size to carry more current without overheating or conversely, will allow even smaller switches to reliably operate. Finally, the density of the low melting alloys is approximately one half the density of mercury. This provides for a potential weight savings in weight-sensitive applications.

Figure 3A:
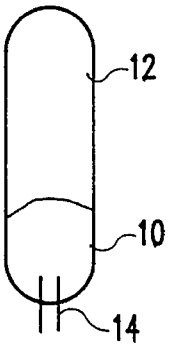
FIGS. 3*a* and 3*b* are drawings of electrical switches where the gallium alloy does not coat, and coats the inside of the switch housing, respectively.
Figure 3B:
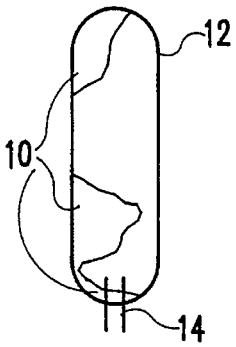

FIGS. 3*a* and 3*b* show an example of an electrical switch where the conductive fluid 10 has not wetted the switch housing 12 and an example of a switch where the conductive fluid 10 has wetted the switch housing 12, respectively. The shape of the switch housing 12 can vary widely from that shown in FIGS. 3*a* and 3*b*, depending on the application in which the switch is to be used. If the conductive fluid 10 wets the switch housing 12, the connection between the electrodes 14 will not be broken when the switch housing 12 is tilted or completely inverted. Thus, "wetting" of the switch housing 12 results in a failure of the switch. A wide variety of materials are currently used for switch housings 12, including glasses (soft 19–29% lead, and hard 5–10% lead), metals, polymers, and ceramics. In addition, a wide variety of materials are currently used for electrodes 14, including tungsten, nickel-iron, copper coated alloys, molybdenum, nickel, and platinum. In order for the switch to perform properly, it is important that the conductive fluid 10 not wet the switch housing. Ideally, the conductive fluid 10 will not react with any of the wide variety of materials currently used for switch housings 12 and electrodes 14, but in some cases will intentionally wet some or all of the electrodes comprising the switch.

Experiments have shown that gallium and gallium alloys such as those described above are readily oxidized when exposed to ambient air. Oxidation changes the color of the alloy from highly reflective to a dull grey. The dull grey color may be considered aesthetically objectionable by consumers that are used to handling mercury. More importantly, oxidation drastically changes the performance characteristics of the alloy in the switch. Specifically, the oxidized alloy may have a higher electrical resistance, and it is more prone to wet the inside of a switch housing or to bridge the electrodes. Initial experiments demonstrated that a number of different materials would be wetted by oxidized gallium alloys including glass and high density polyethylene. However, subsequent experiments demonstrated that when oxides of the metal components in the gallium alloy were removed and formation of oxides during and after switch fabrication were prevented, the gallium alloy would not wet the switch housing materials. Thus, proper handling of the gallium alloy can make the material useful as a conducting fluid in an electrical switch with no treatment of the switch housing. This observation has not heretofore been observed by any other group. In fact, substantial wetting problems with gallium and gallium alloys may explain why these materials have not been commercially used as a substitute for mercury.

FIG. 1 shows a schematic drawing of an apparatus designed to prepare electrical switches and sensors (thermometers, etc.) that will employ gallium and gallium alloys. Gallium and other metals will be dispensed at dispensing station 16. The metals can be combined together at the dispensing station 16 or dispensed separately from individual containers. The metals may be in solid or liquid form at the dispensing station 16. If in solid form, the gallium alloy will be formed by heating the metals after they have been deposited in switch or sensor capsule 18. Likewise, if separate dispensers are used for each metal (tin, indium, bismuth, etc.), and the metals are in liquid state, the gallium alloy will be prepared after the metals are deposited in the capsule 18 by heat treatment. Heat can be applied to the metal within the capsule using conventional heating techniques, irradiation techniques, or by other means. Alternatively, it has been found quite practical to create the alloy prior to its being dispensed from the dispensing station 16 into the capsule 18.

In addition, despite the fact that the melting point of indium is 157° C. and the melting point of tin is 232° C., we have formed low melting alloys from these elements with gallium at low temperature. Specifically, if each of the ingredients is first treated to remove the metal oxide surface layer (using base (NaOH), for example), then alloy can be prepared at just above room temperature (near 30° C., the melting point of gallium) in a short period of time. We view the gallium as essentially a "solvent" for the other ingredients. Forming the gallium alloys at a temperature just above room temperature is preferable, since heat treatment can result in some waste of the material.

The capsule 18 can be made from a wide variety of materials including polymers, glasses, ceramics and metals. The inside of the capsule 18 can be pre-filled with an inert atmosphere, evacuated by vacuum pressure, and/or can be pre-treated with an anti-oxidant, an acid or base wash, or with a polymer coating. Fluoroalkyl acrylate polymer coatings available from 3M have been found to be less likely to wet than some untreated materials. Silicone coatings that are used for conventional mercury switches also work well with the low melting alloys.

However, the chief requirement to prevent wetting of the capsule 18 is to prevent oxidation of the gallium alloy itself. Oxidation has a significant impact on switch performance. The metals dispensed at dispensing station 16 should be pretreated to remove oxides prior to the metals being deposited in the capsule. Oxide removal can be accomplished by a number of different procedures. For example, each of the metals in the gallium alloy can individually be exposed to an acid or base wash, or be exposed to some other chemical or physical or mechanical procedure for removing oxides. Alternatively, the gallium alloy can be created first and then be exposed to chemical, mechanical or physical processes that remove oxides.

Experiments have been conducted with both HCl and NaOH as wash solutions for the metals in the gallium alloy. The metals are washed simply by mixing the metals together with HCl or NaOH. Although HCl will remove oxides from gallium, indium and tin, it has been found that HCl has the disadvantage of reacting with the metals to form metal chlorides. The presence of metal chlorides in the gallium alloy is detrimental to switch or sensor performance. It has been observed that switches prepared with gallium/indium/tin where each ingredient was pretreated with HCl, have resulted in switches where the switch housing was coated with a hazy white material. Conversely, when the metals in the gallium alloy were treated with NaOH, residual reaction products of the metals with the NaOH were not created. It is expected that a wide variety of different acids, bases, and other compounds can be used to remove the oxides from the metals in the gallium alloy, and the use of NaOH and HCl should be considered merely exemplary.

An intentional, low level of metal oxide on the surface of the low melting alloy may be beneficial to switch performance in some applications. In such an application, the tiny metal oxide particles would serve to reduce the amount of liquid-solid contact between the alloy and the housing. This can render the alloy more responsive than a conventional alloy. Aluminum chloride, for example, has been used in specialty mercury switches. However, in all cases, the level of metal oxide in the gallium alloy should be kept extremely low to prevent surface wetting problems and preferably should not exceed 1% by weight of the alloy and is most preferably less than 0.1% by weight of the alloy.

Figure 2:
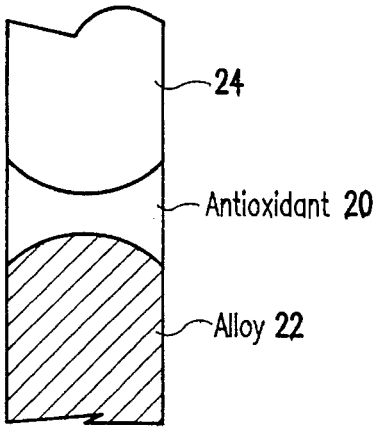
FIG. 2 is an enlarged side view of a dispensing line showing that the gallium or gallium alloy is protected during dispensing by an anti-oxidant and an inert atmosphere.

After oxides have been removed from the metals in the gallium alloy, further oxidation of the metals should be avoided. FIG. 2 shows that an antioxidant 20, which can simply be excess NaOH or the like, can be positioned on top of the gallium alloy 22 at the interface with air to prevent oxidation of the gallium alloy 22 prior to its being dispensed from dispenser tube 24. Other production techniques can be used to separate the gallium alloy from ambient air while it is being dispensed.

FIG. 1 also shows that the capsule 18 and conduit 30 (or conduits—not shown) connected with the dispensing station 16 are connected with a purge station 26 and a vacuum and fill station 28. It is important to understand that oxidation of gallium and gallium alloys occurs very rapidly. Therefore, using an apparatus which prevents oxide formation during dispensing is particularly advantageous. The vacuum will draw ambient air out of the capsule 18 prior to its being filled with gallium alloy. In this way, gallium will not react with ambient air inside the capsule when it is dispensed. The purge station 26 preferably clears the conduit 30 and capsule 18 with an inert gas such as nitrogen or evacuates the conduit and capsule. In this manner, any gallium alloy in the conduit 30 will be protected from oxidation. After gallium alloy is installed in the capsule 18, an inert gas such as hydrogen or argon is added to the capsule 18 such that no air remains in the capsule 18 upon closure by welding 32 or other closing technique. Hydrogen is a less expensive gas to fill the capsule 18; however, argon may be preferred since it is superior to hydrogen at extinguishing arcs. Helium may also be useful.

A prototype dispensing system has been constructed and has been used to reproducibly build switches. The dispensing station has a reservoir to hold approximately 400-ml of low melting alloy. The alloy is stored beneath a layer of aqueous base. Below the reservoir are two spaced apart tapered ground glass stopcocks with a graduated tube therebetween. The graduated tube is connected to a vacuum source and is evacuated prior to delivery of the alloy from the reservoir. A switch housing that is to be filled with the gallium alloy is affixed to the delivery tube of the apparatus and it too is evacuated. The lower stopcock allows a measured amount of alloy (e.g., some or all of the alloy in the graduated tube) to be dispensed through the delivery tube into the switch housing. The switch housing is backfilled with hydrogen gas and is subsequently sealed. Finally, while the switch is being removed a nitrogen purge is initiated. The nitrogen purge fills the delivery tube with a nonoxidizing, dry atmosphere. In this way, the interior surface of the delivery tube is kept clean and dry. Further, if any alloy remains in the delivery tube it does not oxidize. This equipment is a simple prototype version of an apparatus that can be built to construct large quantities of switches. It also lends itself to automation.

While the invention has been described in terms of its preferred embodiments, those skilled in the art will recognize that the invention can be practiced with modification within the spirit and scope of the appended claims.

We claim:

1. A method for producing an electrical switch or sensor which utilizes gallium, comprising the steps of:

removing metal oxides from gallium or a gallium alloy;

dispensing said gallium or gallium alloy into a switch or sensor housing; and preventing the formation of metal oxides in said gallium or gallium alloy during and after said step of dispensing.

2. The method recited in claim 1 wherein said step of removing oxides is accomplished by treating said gallium or gallium alloy with an acid.

3. The method recited in claim 1 wherein said step of removing oxides is accomplished by treating said gallium or gallium alloy with a base.

4. The method recited in claim 1 wherein said step of removing oxides is accomplished by exposing said gallium or gallium alloy to a reducing agent.

5. The method recited in claim 1 wherein said preventing stem includes the step of positioning an antioxidant on top of said gallium or gallium alloy during said dispensing step.

6. The method recited in claim 5 wherein said step of positioning includes adding excess NaOH to said gallium or gallium alloy.

7. The method recited in claim 1 wherein said step of preventing includes the step of purging said switch or sensor housing with an inert gas prior to said step of dispensing.

8. The method recited in claim 1 wherein said step of preventing includes the step of evacuating said switch or sensor housing with a vacuum.

9. The method recited in claim 1 further comprising the step of adding an inert gas to said switch or sensor housing after said step of dispensing.

10. An apparatus for making an electrical switch which utilizes gallium, comprising:

means for dispensing a gallium or gallium alloy into a switch or sensor housing; and means for preventing formation of oxides of said gallium or gallium alloy wherein said means for preventing includes a means for purging air from a dispensing head connected to said means for dispensing.

11. The apparatus of claim 10 wherein said means for preventing includes a means for separating said gallium or gallium alloy from air while it is being dispensed by said dispensing means.

12. The apparatus of claim 10 wherein said means for preventing includes a means for evacuating air from said switch or sensor housing.

13. The apparatus of claim 10 wherein said means for preventing includes a means for adding an inert gas to said switch or sensor housing.

14. A switch or sensor, comprising:

a hollow housing;

a liquid metal comprised of a gallium alloy positioned inside an internal volume within said hollow housing, said liquid metal having less than 0.1% metal oxides by weight, said liquid metal being flowable within said internal volume within said hollow housing and not wetting an inside wall of said internal volume of said hollow housing, wherein said liquid metal is a gallium alloy which has a freezing point of less than 0° C.; and an inert gas positioned inside said internal volume within said hollow housing, said metal and said inert gas completely filling said internal volume within said hollow housing.

* * * * *